US005380628A

United States Patent [19]

Sawyer et al.

[11] Patent Number: 5,380,628

[45] Date of Patent: Jan. 10, 1995

[54] METHOD OF PREPARING COUPLER DISPERSIONS

[75] Inventors: John F. Sawyer, Fairport; Paul L. Zengerle, Rochester, both of N.Y.

[73] Assignee: Eastman Kodak Company, Rochester, N.Y.

[21] Appl. No.: 737,076

[22] Filed: Jul. 29, 1991

[51] Int. Cl.[6] ..... G03C 7/388

[52] U.S. Cl. ..... 430/449; 430/546; 430/631; 430/634; 430/635; 430/636; 210/634; 210/644; 210/799; 252/314

[58] Field of Search ..... 430/546, 545, 493, 631, 430/634, 636, 635, 449; 210/799, 634, 644; 252/314

[56] References Cited

U.S. PATENT DOCUMENTS

| | | | |
|---|---|---|---|
| 2,949,360 | 8/1960 | Julian | 430/546 |
| 3,860,425 | 1/1975 | Ono et al. | 96/82 |
| 3,936,303 | 2/1976 | Shiba et al. | 96/74 |
| 4,233,397 | 11/1980 | Tada et al. | 430/449 |
| 4,291,113 | 9/1981 | Minamizono et al. | 430/202 |
| 4,385,110 | 5/1983 | Yoneyama et al. | 430/372 |
| 5,013,640 | 5/1991 | Bagchi et al. | 430/546 |
| 5,015,564 | 5/1991 | Chari | 430/546 |
| 5,024,929 | 6/1991 | Lougheed et al. | 430/546 |
| 5,135,844 | 8/1992 | Bagchi et al. | 430/639 |

FOREIGN PATENT DOCUMENTS

| | | |
|---|---|---|
| 0182658 | 5/1986 | European Pat. Off. . |
| 0362990 | 4/1990 | European Pat. Off. . |
| 0397086 | 11/1990 | European Pat. Off. . |

OTHER PUBLICATIONS

PCT International Search Report, PCT/US/92/06225.

Journal of Medicinal Chemistry, vol. 18, No. 9, Sep. 1975, pp. 865–868, A. Leo et al., "Calculation of Hydrophobic Constant . . . Constants".

*Primary Examiner*—Lee C. Wright

*Attorney, Agent, or Firm*—Edith A. Rice

[57] ABSTRACT

Fine particle photographic coupler dispersions are prepared by forming a dispersion of a photographic coupler, coupler solvent and auxiliary coupler solvent in an aqueous gelatin medium containing at least about 1% by weight of an anionic surfactant selected from the group consisting of alkali metal salts of alkarylene sulfonic acids, alkali metal salts of alkyl sulfates, alkaryl sulfonate salts, and alkyl sulfosuccinates; and washing the dispersion with water for a time sufficient to remove at least one-fourth of the surfactant.

20 Claims, No Drawings

METHOD OF PREPARING COUPLER DISPERSIONS

BACKGROUND OF THE INVENTION

1. Field of the Invention

This invention relates to a method of preparing coupler dispersions for photographic use and more particularly, to a method of preparing extremely fine size coupler dispersions.

2. Description of Related Art

Copending application Ser. No. 631,607 entitled "Color Photographic Element", filed Dec. 21, 1990 by a number of the same applicants as this application and assigned to the same assignee as this application discloses a particular color photographic element wherein the image-dye forming couplers of certain layers are in a dispersion having a mean particle size of less than 0.14 microns. One of the advantages at least partially attributable to utilizing coupler dispersions of reduced particle size is that photographic elements employing such coupler dispersions exhibit reduced granularity.

U.S. Pat. No. 4,385,110 issued May 24, 1983, teaches that in order to make the particle size of an emulsion dispersion finer, it is usually necessary to use an emulsifying agent in a large amount. The use of an emulsifying agent in a large amount is liable to cause coating troubles due to foaming of the emulsion, such as the formation of pin holes, unevenness in the coated film thickness, and to deteriorate the film quality of the coated photographic element of a light-sensitive material.

In the manufacture of dispersions for use in photographic light-sensitive elements, such as coupler dispersions, the photographic coupler is dissolved in a permanent coupler solvent with the addition of an auxiliary coupler solvent that assists in the dissolution of the coupler in the permanent coupler solvent. This solution is mixed under high shearing action with an aqueous hydrophilic colloid, generally gelatin, containing a surfactant at elevated temperatures in order to break the organic phase into sub-micron droplets dispersed in the continuous aqueous phase. The auxiliary coupler solvent is then removed from the aqueous dispersion. Two techniques are employed for removing the auxiliary coupler solvent and these techniques depend upon the characteristic of the auxiliary coupler solvent. When the auxiliary coupler solvent is of low volatility, it is generally removed by evaporative techniques. When the auxiliary coupler solvent is less volatile, but at least partially water soluble, it is removed by washing by any suitable technique such as noodling coupled with washing as disclosed in U.S. Pat. Nos. 2,322,027; 2,801,170; 2,801,171; 2,949,360; and 3,396,027. Another suitable technique to employ is a membrane wherein the dispersion is contacted across the membrane as disclosed in copending U.S. application Ser. No. 516,955 filed Apr. 30, 1990, which application is assigned to the same assignee as this application.

There is a need for a simplified method of making photographic coupler dispersions wherein the particle size of the coupler dispersion is reduced from those techniques presently employed in the art.

SUMMARY OF THE INVENTION

The invention provides a method of making fine particle photographic coupler dispersions by forming a dispersion of a photographic coupler together with a coupler solvent and an auxiliary coupler solvent in an aqueous hydrophilic colloid medium containing at least about 1% by weight of an anionic surfactant having a hydrophobicity of from 2 to 10 log P(OH) and washing the dispersion with water for a time sufficient to remove at least one-fourth of the surfactant. By "fine particle" is meant a dispersion in which the average size of the oil phase droplet is less than 0.25 μm, preferably less than 0.2 μm and most preferably less than 0.15 μm as measured by sedimentation field flow fractionation (SFFF).

DESCRIPTION OF THE PREFERRED EMBODIMENT

In a preferred embodiment, an oil phase comprising the coupler, the coupler solvent and the auxiliary coupler solvent are mixed together and heated in order to dissolve the coupler in the combination of solvents. An aqueous phase comprising a hydrophilic colloid, water and at least 1% by weight, preferably from 1 to 5 percent by weight of an anionic surfactant having a hydrophobicity of from 2 to 10 log P(OH) is prepared. The two components, that is, the oil phase and the aqueous phase are next intimately mixed together using a mixing device such as a colloid mill or homogenizer to achieve a particle size of the oil phase in the aqueous phase as desired. Finally, the dispersion is washed with water by any suitable technique in order to reduce the amount of the surfactant to at least one-fourth of the quantity of surfactant originally added. The washing step can be conducted by dialysis, such as that described in U.S. Pat. No. 5,024,929 (which is incorporated herein by reference) or the dispersion can be chilled, extruded into noodles and then washed with water together with agitation. In either technique, the washing is conducted until at least one quarter of the surfactant has been removed.

The rate that the surfactant can be washed from the dispersion is dependent upon the hydrophobicity of the particular surfactant. Generally the higher the hydrophobicity of the surfactant the longer the washout rate must be in order to provide the fine particle characteristics of the dispersion necessary for satisfactory use in the preparation of a light-sensitive silver halide element. Any suitable anionic surfactant may be employed wherein the hydrophobicity as measured Log P(OH) is from about 2 to 10. It is preferred that the hydrophobicity of the surfactant range from about 2.5 to about 7 and most preferably from about 4 to about 6.7 in order to provide most satisfactory results.

It has been found experimentally that the advantages of improved dispersion stability to droplet growth and crystallization, lower dispersion viscosity and improved coatability with the avoidance of streaking and repellencies are due to the combination of the use an excess amount of surfactants together with the washing procedure to reduce the amount of surfactant in the dispersion. When evaporation techniques are employed together with an excess quantity of surfactant, the viscosity of the resulting dispersion increases so dramatically as to render it useless in the preparation of light-sensitive layers for photographic elements, and this is true regardless of the hydrophobicity of the surfactants employed.

The process in accordance with this invention is applicable for the formation of dispersions containing all types of couplers such as those set forth in UK Patent No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343,703, 2,376,380 and 2,369,489, Spath U.K. Patent No. 886,723 and U.S. Pat. No. 2,899,306, Tuite U.S. Pat. No. 3,152,896 and Mannes et al U.S. Pat. Nos. 2,115,394, 2,252,718 and 2,108,602, ad Pilato U.S. Pat. No. 3,547,650. In this form the developer contains a color-developing agent (e.g., a primary aromatic amine) which in its oxidized form is capable of reacting with the coupler (coupling) to form the image dye. The dye-forming couplers can be incorporated in different amounts to achieve different photographic effects. For example, U.K. Patent No. 923,045 and Kumai et al U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Patent No. 969,921, U.S. Pat. No. 1,241,069, U.K. Patent No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Patent No. 975,928, U.K. Patent No. 1,111,554, Jaeken U.S. Pat. No. 3,222,176 and Canadian Patent No. 726,651, Schulte et al U.K. Patent No. 1,248,924 and Whitmore et al U.S. Pat. No. 3,227,550.

Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Patent No. 1,201,110, Oishi et al U.S. Pat. No. 3,462,485, Verbrugghe U.K. Patent 1,236,767, Fujiwhara et al U.S. Pat. No. 3,770,436 and Matsuo et al U.S. Pat. No. 3,808,945. Dye-forming couplers and nondye-forming compounds which upon coupling release a variety of photographically useful groups are described in Lau U.S. Pat. No. 4,248,962. DIR compounds which do not form dye upon reaction with oxidized color-developing agents can be employed, as illustrated by Fujiwhara et al German OLS No. 2,529,350 and U.S. Pat. Nos. 3,928,041, 3,958,993 and 3,961,959, Odenwalder et al German OLS No. 2,448,063, Tanaka et al German OLS No. 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129.

Particular couplers which may be used according to the invention are those disclosed in U.S. Pat. Nos. 2,322,027; and the following:

(1) 1-hydroxy-2-[o-(2′,4′-di-tert amylphenoxy)-n-butyl]-naphthamide (U.S. Pat. No. 2,474,293)

(2) 1-hydroxy-4-phenylazo-4′-(p-tert butylphenoxy)-2-naphthanilide (U.S. Pat. No. 2,521,908)

(3) 2-(2,4-di-tert amylphenoxyacetamino) -4,6-dichloro-5-methyl phenol (Graham U.S. Pat. No. 2,725,291)

(4) 2-(α-Di-tert amylphenoxy-n-butyrylamino)-4,6-dichloro-5-methyl phenol (5) 6-{{α-{4-[α-(2,4-di-tert amylphenoxy)-butylamido]phenoxy}-acetamido}}-2,4-dichloro-3-methyl phenol (6) 2-[3′-(2″,4″-diamylphenoxy)-acetamido]-benzamido-4-chloro-5-methyl phenol (7) 1-(2′,4′,6′-trichlorophenyl)-3-[3″-(2‴,4‴-di-tert amylphenoxy-acetamido)benzamido[-5-pyrazolone (U.S. Pat. No. 2,600,788)

(8) 1-(2′,4′,6′-trichlorophenyl)-3-[3″-(2‴,4‴-di-tert-amylphenoxyacetamido-benzamido]-4-(p-methoxyphenylazo)-5-pyrazolone (9) N-(4-benzoylacetaminobenzenesulfonyl)-N-(γ-phenylpropyl)-p-toluidined (U.S. Pat. No. 2,298,443)

(10) α-o-methoxybenzoyl-α-chloro-4-[α-(2,4-di-tertamylphenoxy)-n-butylamido)acetanilide (McCrossen U.S. Pat. No. 2,728,658)

(11) α-{3-[α-(2,4-di-tert amylphenoxy) acetamido]-benzoyl}2-methoxy-anilide

(12) 3-benzoylacetamino-4-methoxy-2′,4′-di-tert amylphenoxyacetanilide

(13) 4-benzoylacetamino-methoxy-2′,4′-di-tert amylphenoxyacetanilide

The terms "coupler solvents" and "auxiliary coupler solvents" are terms widely used in the photographic industry and are understood by those working in this environment. Coupler solvents are substantially water insoluble, of low molecular weight and have a boiling point above about 175° C. at atmospheric pressure and a high solvent action for the coupler and dyes formed therefrom, and are permeable to photographic developer oxidization products. Auxiliary coupler solvents enhance the coupler solubility and have a water solubility within the range of from about 2.5 to 100 parts of solvent per 100 parts of water.

Suitable coupler solvents include alkyl esters of phthalic acid in which the alkyl radical preferably contains less than 12 carbon atoms, for example, methylphthalate, ethylphthalate, propylphthalate and n-butylphthalate, di-n-butylphthalate, n-amylphthalate, isoamylphthalate dioctylphthalate, didecylphthalate didodecylphthalate, 1,4-cyclohexylene dimethylene bis(2-ethyl hexanoate), 2,4-di-tert-amyl phenol, esters of phosphoric acid, for example, triphenylphosphate, tri-o-cresylphosphate and diphenylmono-p-tert.butylphenyl phosphate, and alkyl amides or acetanilides, for example, N,n-butylacetanilide and N-methyl-p-methyl acetanilide. The coupler solvents disclosed in U.S. Pat. No. 3,936,303 (incorporated herein by reference) are suitable for use in this invention. The coupler solvents preferably have a water solubility of less than about 0.1 part of solvent in 100 parts of water and are generally employed in amounts less than 2 parts of coupler solvent per part of coupler by weight.

Suitable auxiliary coupler solvents include esters of aliphatic alcohols with acetic or propionic acid, for example, ethylacetate, isopropyl acetate, ethylpropionate, beta-ethoxyethyl acetate, 2-(2-butoxy-β-ethoxy)ethyl acetate, cyclohexanone, triethyl phosphate and the like. The coupler solvents and auxiliary coupler solvents set forth in U.S. Pat. No. 2,949,360, which is incorporated herein by reference are suitable in the practice of this invention.

Any suitable anionic surfactant having a hydrophobicity between the limits set forth above may be employed in the quantity set forth such as, for example, alkali metal salts of alkarylene sulfonic acid such as the sodium salt of isobutylnaphthalene sulfonic acid, a particularly useful one of which is a mixture of monomers, dimers, trimers, and tetramers of the sodium salt of isopropylnaphthalene sulfonic acid, sold by DuPont Company under the trade designation ALKANOL XC; alkali metal salts of alkyl sulfates such as for example, sodium octyl sulfate, sodium decyl sulfate, sodium dodecyl sulfate, sodium tetradecyl sulfate, the corresponding potassium salts, and the like; alkaryl sulfonate salts, such as, sodium and potassium dodecyl benzene sulfonate; alkyl sulfosuccinates such as, for example, sodium bis(2-ethylhexyl)succinic sulfonate; a particularly suitable one of which is sold under the trade designation AEROSOL OT by American Cyanamid, diethylpentyl sodium sulfosuccinate and the like.

Any suitable hydrophilic colloid such as, those disclosed in Research Disclosure, Issue Number 308, December 1989 in paragraph IX, A, may be used in accordance with this invention.

The method of this invention can also be employed in the manufacture of other photographically useful chemicals such as, U.V. absorbers and oxidized developer scavengers including those set forth in Research Disclosure, Issue 308, Dec. 1989, Paragraph 8C and Paragraph 7I, respectively.

The invention will be further illustrated by the following examples in which parts and percentages are by weight unless otherwise specified.

EXAMPLE 1

An oil phase component is prepared by heating to about 120° C. about 40 grams of the coupler having the following formula:

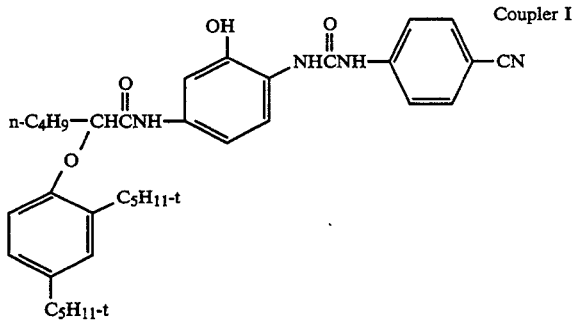

about 40 grams of coupler solvent, di-n-butyl-phthalate and about 80 grams of auxiliary coupler solvent 2-(2-butoxyethoxy)ethylacetate to dissolve the coupler.

An aqueous phase component is prepared by heating at 50° C. about 80 grams of gelatin, about 1.0% of the sodium salt of isobutylnaphthalene sulfonic acid sold by Dupont under the trade designation Alkanol XC and about 664 grams of distilled water to dissolve the gelatin.

The two phases are then combined and passed through a colloid mill five times to form fine oil particles.

The dispersion is then chill set, noodled and washed 8 hours to remove auxiliary coupler solvent and surfactant. The dispersion is then remelted, stirred and chill set.

The resulting dispersion has an average particle size of 0.12 μm, as measured by sedimentation field flow fractionation (SFFF) described in Research & Development (pp 78–82, September, 1986), incorporated herein by reference. This dispersion is then incorporated into the red sensitive layers of a light sensitive photographic element as described in Example 1 of co-appending application U.S. Ser. No. 631,607, filed Dec. 2, 1990, incorporated herein by refernce, which exhibits reduced granularity without any adverse effects on coating quality.

EXAMPLE 2

The procedure of Example 1 is repeated with the exception that 20 grams of tricresylphosphate are employed as the coupler solvent in the oil phase and 684 grams of distilled water are employed in the aqueous phase. All of the remaining quantities and conditions remain the same. This dispersion having an average particle size of 0.12 μm (SFFF) is employed in a light sensitive element in accordance with Example 1 and provides reduced granularity.

EXAMPLE 3

Example 1 is once again repeated with the exception that the oil phase is heated to about 100° C. to dissolve the coupler. About 27.5 grams of a coupler having the formula:

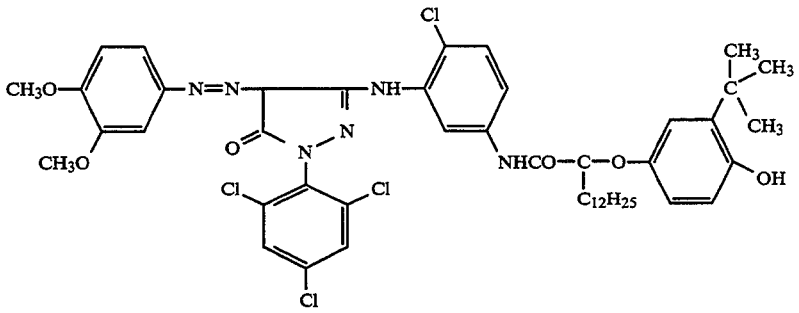

and about 55 grams of the coupler solvent of Example 2 and about 55 grams of the same auxiliary coupler solvent as employed in Example 1 are used. The aqueous phase is made up of 80 grams of gelatin, 150 grams of the same surfactant as in Example 1 and 632 grams of distilled water. The average particle size of the dispersion is about 0.13 μm as measured by (SFFF). The dispersion is incorporated into a light sensitive element in accordance with U.S. Ser. No. 631,607 which demonstrates reduced granularity.

EXAMPLE 4

The general procedure of Example 1 is repeated with the exception that the oil phase is heated to about 50° C. in order to dissolve the coupler which is 40 grams of

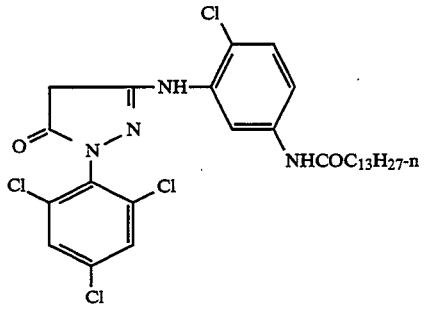

about 20 grams of tricresylphosphate in about 120 grams of 2-(2-butoxyethoxy)ethylacetate. The aqueous phase contains about 80 grams of gelatin, about 120 grams of the surfactant of Example 1 and about 620 grams of distilled water. This dispersion having an average particle size of 0.10 μm is incorporated into the green sensitive layers of a light sensitive element as described in Example 1 of copending application U.S. Ser. No. 631,607 which exhibits reduced granularity without any adverse effects on coating quality.

EXAMPLE 5

Once again the general procedure of Example 1 is followed with the exception that 40 grams of a coupler having the following formula:

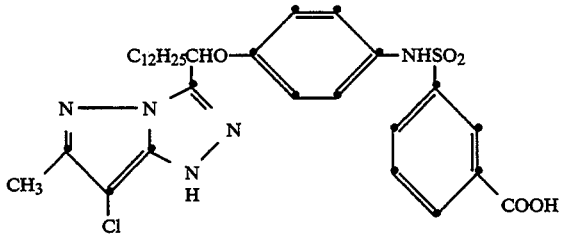

20 grams of tricresylphosphate and 120 grams of 2-(2-butoxyethoxy)ethylacetate are heated to about 80° C. in order to dissolve the coupler in the coupler solvent and auxiliary coupler solvent. The aqueous phase contains about 80 grams of gelatin, about 100 grams of the surfactant of Example 1, about 20 grams of polyvinylpyrrolidone having an average molecular weight of about 40,000 and 620 grams of distilled water. The remaining conditions of Example 1 are the same. This coupler having an average particle size of 0.02 μm is incorporated in green sensitive layer 7 as described in U.S. Ser. No. 631,607 and exhibits improved granularity.

EXAMPLE 6

The procedure of Example 1 is generally repeated with the exception that 70.0 g of coupler is

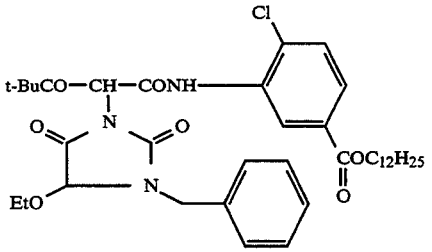

disolved in about 23.3 grams of di-n-butylphthalate and about 140 grams of 2-(2-butoxyethoxy)ethylacetate are heated to about 80° C. to dissolve the coupler in the solvents. The aqueous phase is composed of 70 grams of gelatin, about 120 grams of the surfactant of Example 1, and 607 grams of distilled water. This dispersion is incorporated into the blue sensitive layers of the light sensitive element described in Example 1 of U.S. Ser. No. 631,607 which exhibits reduced granularity.

COMPARISON OF SEPARATION BY EVAPORATION WITH WASHING METHOD IN ACCORDANCE WITH THE INVENTION

EXAMPLE 7

A series of washed and evaporated dispersions were prepared according to the following formulation:

| | | |
|---|---|---|
| Coupler 1 (Example 1) | 6.0% | Oil Phase |
| Coupler Solvent-Di-n-butylphthlate | 6.0% | |
| Auxiliary Coupler Solvent | 12.0% | |
| Gelatin | 6.0% | Aqueous Phase |
| sodium salt of isopropyl-naphthalene sulfonic acid | 0.6% or 1.2% | |
| Distilled water | 69.4% or 68.8% | |

The two phases were combined and passed through a colloid mill five times to form small oil particles. In the case of the evaporated dispersions, ethyl acetate was employed as the auxiliary solvent and was removed by evaporation. In the case of the washed dispersions, 2-(2-butoxyethoxy) ethyl acetate was used as the auxiliary solvent and was removed by washing. The dispersions were held without stirring for 24 hours at 45° C. and then examined microscopically to determine the degree of coupler crystallization. Dispersion viscosities were also measured using a Brookfield Model HBT-DV II viscometer. Particle size was determined by the light scattering method described in UK Patent 2071841B. The results are summarized in the following table:

| Surfactant Level | Auxiliary Solvent Removal Method | Dispersion Particle Size (μm) | Viscosity (cps) at 1500 $sec^{-1}$ | Degree of Crystallization |
|---|---|---|---|---|
| 0.6% | Evaporated | 0.18 | 55.5 | Heavy |
| 1.2% | Evaporated | 0.12 | 270.0 | Very Heavy |
| 0.6% | Washed | 0.20 | 23.1 | None |
| 1.2% | Washed | 0.14 | 45.6 | Modest |
| 1.2% | Washed | 0.13 | 37.7 | Modest |

The results demonstrate that fine particle dispersions are obtained only when the high level of surfactant is employed. However, in the case of evaporated dispersions, the dispersion viscosity is much too high and severe crystallization is observed. The washed dispersions made at the high surfactant level exhibit small particle sizes with reasonable viscosities and an acceptable position for dispersion crystallization due to the partial removal of surfactant during washing.

EXAMPLE 8

A series of dispersions were prepared as described in the previous example except that sodium bis (2-ethylhexyl) succinic sulfonate, sold under the trade designation Aerosol-OT was employed as the dispersion surfactant. These dispersions were also characterized in terms of particle size and viscosity. They were also examined microscopically for crystallization following an 8 hour, 45° C. hold. Results are summarized below:

| Surfactant Level | Auxiliary Solvent Removal Method | Dispersion Particle Size (μm) | Viscosity (cps) at 1500 $sec^{-1}$ | Degree of Crystallization |
|---|---|---|---|---|
| 0.6% | Evaporated | 0.16 | 60.0 | Modest |
| 1.2% | Evaporated | 0.10 | 301.0 | Heavy |
| 0.6% | Washed | 0.18 | 23.9 | Little |
| 1.2% | Washed | 0.12 | 49.6 | Little |
| 1.2% | Washed | 0.12 | 44.8 | Little |

These results also show that small particle sizes are obtained at the high surfactant levels. With the evaporated dispersions, very high viscosity and heavy crystallization is observed. Only the combination of high surfactant level followed by washing produces fine particles with reasonable viscosity and an acceptable position for crystallization.

EXAMPLE 9

A number of different anionic surfactants having varying hydrophobicities were used to prepare dispersions by the procedure conducted in Example 1. The conditions and ingredients were the same, however, the surfactant was altered in each case, the quantity of each being in equal molar amounts as the surfactant of Example 1. The concentration of surfactant was monitored in order to determine the time of removal and the particle size of the dispersions was measured by SFFF. The results establish that fine particle dispersions can be prepared by this method with a variety of surfactants. They also demonstrate that one-quarter of the surfactant can be removed in a reasonable time.

The compositions of the surfactants employed and set forth in Table 1 are as follows:

TABLE 1

(1) sodium salt of isopropylnaphthalene sulfonic acid
Alkanol XC (Dupont)

(2) sodium decyl sulfate (3) sodium dodecyl sulfate

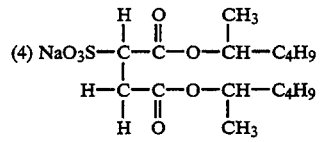

(4) Aerosol-MA (American Cyanamid)

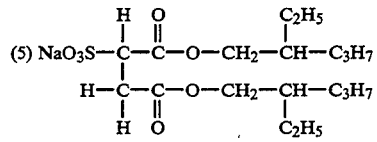

(5) Di-ethylpentyl sodium sulfosuccinate

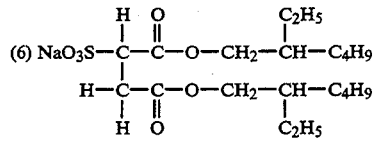

(6) Aerosol-OT (American Cyanamid)

TABLE 1-continued (7) 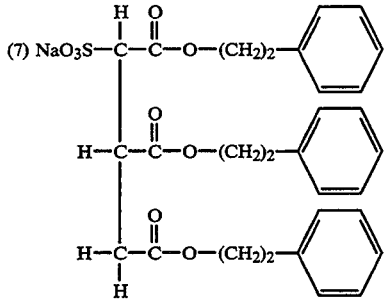

(8) 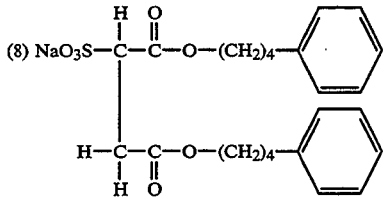

(9) Sodium Dodecylbenzene Sulfonate

| Surfactant | Hydrophobicity LOG P (OH) | Time $t_{\frac{1}{2}}$ | Particle Size μm |
|---|---|---|---|
| 1* | 4.96 | 0.9 | 0.117 |
| 2 | 4.00 | 0.3 | 0.137 |
| 3 | 5.06 | 2.6 | 0.11 |
| 4 | 4.34 | 0.11 | 0.127 |
| 5 | 5.58 | 1.1 | 0.101 |
| 6 | 6.64 | 4.1 | 0.076 |
| 7 | 5.79 | 13.3 | 0.07 |
| 8 | 5.8 | 19.5 | 0.079 |
| 9 | 6.62 | 17.0 | 0.078 |

*average of four runs each having a different isomer ratio.

We claim:

1. A method of making a fine particle photographic coupler dispersion having an average particle size of less that 0.15 μm, which comprises mixing a photographic coupler, coupler solvent and auxiliary coupler solvent into an aqueous gelatin medium containing at least 1% by weight of an anionic surfactant selected from the group consisting of alkali metal salts of alkarylene sulfonic acids, alkali metal salts of alkyl sulfates, alkaryl sulfonate salts, and alkyl sulfosuccinates; and washing the dispersion with water for a time sufficient to remove at least one-fourth of the surfactant.

2. A method of claim 1, wherein the surfactant is an alkali metal salt of an alkarylene sulfonic acid.

3. A method of claim 2 wherein the surfactant is the sodium salt of isobutylnaphthalene sulfonic acid.

4. A method of claim 2, wherein the surfactant is a mixture of monomers, dimers, trimers and tetramers of the sodium salt of isopropylnaphthalene sulfonic acid.

5. A method of claim 1, wherein the surfactant is an alkali metal salt of an alkyl sulfate.

6. A method of claim 5, wherein the surfactant is sodium or potassium octyl sulfate.

7. A method of claim 5, wherein the surfactant is sodium or potassium decyl sulfate.

8. A method of claim 5, wherein the surfactant is sodium or potassium dodecyl sulfate.

9. A method of claim 5, wherein the surfactant is sodium or potassium tetradecyl sulfate.

10. A method of claim 1, wherein the surfactant is an alkaryl sulfonate salt.

11. A method of claim 10, wherein the surfactant is sodium and potassium dodecyl benzene sulfonate.

12. A method of claim 1, wherein the surfactant is an alkylsulfosuccinate.

13. A method of claim 12, wherein the surfactant is sodium bis(2-ethylhexyl)succinic sulfonate.

14. A method of claim 12, wherein the surfactant is diethylpentyl sodium sulfosuccinate.

15. A method of claim 12, wherein the surfactant is dimethylpentyl sodium sulfosuccinate.

16. A method of claim 1, wherein the surfactant is present in an amount of 1 to 5 percent by weight.

17. A method of making a fine particle photographic coupler dispersion having an average particle size of less than 0.15 μm which comprises mixing a photographic coupler, coupler solvent and auxiliary coupler solvent into an aqueous gelatin medium containing at least 1% by weight of an anionic surfactant having the formula:

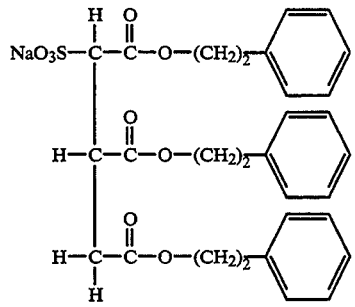

and washing the dispersion with water for a time sufficient to remove at least one-fourth of the surfactant.

18. A method of claim 17, wherein the surfactant is present in an amount of 1 to 5 percent by weight.

19. A method of making a fine particle photographic coupler dispersion having an average particle size of less than 0.15 μm which comprises mixing a photographic coupler, coupler solvent and auxiliary coupler solvent into an aqueous gelatin medium containing at least 1% by weight of an anionic surfactant having the formula:

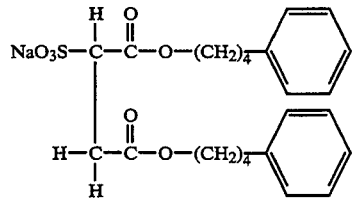

and washing the dispersion with water for a time sufficient to remove at least one-fourth of the surfactant.

20. A method of claim 19, wherein the surfactant is present in an amount of 1 to 5 percent by weight.

* * * * *